US006669575B1

(12) United States Patent
Marlette

(10) Patent No.: US 6,669,575 B1
(45) Date of Patent: Dec. 30, 2003

(54) GOLF SHOT SHAPER TRAINING AID

(76) Inventor: Walter Terry Marlette, 2275 Brickton Station, Buford, GA (US) 30518

( * ) Notice: Subject to any disclaimer, the term of this patent is extended or adjusted under 35 U.S.C. 154(b) by 0 days.

(21) Appl. No.: 10/346,229

(22) Filed: Jan. 16, 2003

(51) Int. Cl.[7] ..... A63B 69/36
(52) U.S. Cl. ..... 473/270; 473/272; 473/273
(58) Field of Search ..... 473/270, 271, 473/272, 273, 278, 279, 218, 266

(56) References Cited

U.S. PATENT DOCUMENTS

| | | | | | |
|---|---|---|---|---|---|
| 3,542,369 | A | | 11/1970 | Anderson | |
| 3,658,344 | A | * | 4/1972 | Kimble | 473/272 |
| 4,387,896 | A | | 6/1983 | O'Brien | |
| 5,322,288 | A | * | 6/1994 | Amis | 473/272 |
| 5,335,915 | A | * | 8/1994 | Baudier | 473/218 |
| 5,362,060 | A | * | 11/1994 | Hinson | 473/218 |
| 5,411,266 | A | | 5/1995 | Guthry | |
| 5,435,727 | A | | 7/1995 | Dobson | |
| 5,464,220 | A | * | 11/1995 | Hansen et al. | 473/218 |
| 5,527,037 | A | * | 6/1996 | Matsumoto | 473/218 |
| 5,616,085 | A | * | 4/1997 | LaCoste et al. | 473/267 |
| 5,860,871 | A | | 1/1999 | Marley, Jr. | |
| 5,919,099 | A | | 7/1999 | Woods | |
| 5,944,613 | A | * | 8/1999 | Dubois | 473/218 |
| 6,077,168 | A | * | 6/2000 | Huang | 473/218 |
| 6,106,408 | A | * | 8/2000 | Roman | 473/266 |
| 6,142,883 | A | | 11/2000 | Ferrara | |
| 6,196,933 | B1 | | 3/2001 | Hope et al. | |
| 6,402,632 | B2 | | 6/2002 | Hope et al. | |
| 6,440,004 | B1 | * | 8/2002 | Rodriguez | 473/218 |
| 6,500,075 | B1 | | 12/2002 | McDevitt | |

* cited by examiner

*Primary Examiner*—Raleigh Chiu

(57) ABSTRACT

An improved golf training aid for right handed or left handed golfers that conditions the golfer through repetition and muscle memory to hit straight shots, controlled fade shots in varying degrees, and controlled draw shots in varying degrees without the need to use different golf swings for each shot or a different grip for each shot. The target arrow (12) is aimed at a chosen target and held into place by means of spikes (16). The invention aligns the golfers feet correctly for each shot by means of a body alignment shaft (60) and positions the golf ball correctly in relation to the golfers stance by means of a heel alignment block (50). The distance the golfers feet are from the ball is set by moving the heel alignment block (50) and the body alignment shaft (60) assembly either up or down the shot selection indicator shaft (40). Varying degrees of the fade and draw shots are achieved by simply rotating the shot selection indicator shaft (40) to the desired shot selection hole (14) and securing with a wing nut (38).

5 Claims, 2 Drawing Sheets

GOLF SHOT SHAPER TRAINING AID

BACKGROUND

1. Field of Invention

The present invention relates to a golf training aid and more particularly relates to a golf training method whereby through repetition, the golfer can develop a repeatable and consistent swing to enable him/her to hit a variety of different types of golf shots.

2. Description of Prior Art

In golf, the ability to hit a straight shot, a controlled fade, or a controlled draw escapes most amateur golfers. They have high handicaps because they don't keep the golf ball in play. These problems are most often the result of poor body alignment and poor ball position. Some golfers make changes in their swing to try to accomplish a controlled fade or a controlled draw. This can result in poor swing habits that may take months to overcome.

There are numerous golf training aids and devices that can be found in the prior art. Most of these training aids assist the golfer in proper alignment and ball position. Several early patents show the golfer how to properly align their stance through gauges, indicators, and alignment shafts. Representative of these devices are U.S. Pat. Nos. 2,150,580, 3,166,327 and 3,229,981. U.S. Pat. Nos. 4,718,674, 4,925,192, 5,042,815 and 5,362,060 are later devices that help teach the golfer how to properly align their body with a target and how to position the ball properly.

U.S. Pat. No. 3,429,577 relates to a golf training method whereas a pair of arcuate shaped members is to be placed on the ground with the golf ball placed in their center. Target members are included to help direct the club path. The golfer stands inline, open or closed to the target direction for hitting a golf ball straight, a fade or a draw. While this device may be useful to some golfers, it lacks the ability to properly align the golfers body or the ball position.

U.S. Pat. No. 5,139,263 shows a golf practice device in the form of a closed frame encircling an open area within which a golf ball may be positioned. Alignment elements are added to enable the golfer to hit straight, fade and draw shots. While helpful to some, this device leaves the golfer with too much guesswork in positioning their body and in positioning the ball in relation to their forward heel.

U.S. Pat. No. 5,611,738 shows a golf swing alignment device for aligning a golfers left foot and right foot with respect to an intended flight path of a golf ball. It consists of a flat main body having a ball placement calibration means for positioning the ball in the golfers stance, oppositely located tapered ends defining a line collinear with the intended flight path, and calibrated left and right legs detachably mounted to the main body.

U.S. Pat. No. 6,089,989 shows a golf instructional apparatus designed to teach a golfer to hit the ball straight and to correct a golfers hook or slice. It's made up of a golf mat having a reference line. It also has a flexible cylinder located in a particular way so that on an improper swing, the golf club will hit it. It is also made up of flexible panels and a sensor.

The aforementioned patents are representative of numerous patents that relate to golf training devices. The prior art generally shows devices utilizing panels, strips, shafts, etc. to assist in the proper stance, proper alignment and proper ball position for the golfer. The goal being that through repetition, the golfer will build a repeatable, reliable golf swing.

There are many elements that make up a good golf swing. Some being, body alignment, ball position, swing plane and tempo. One of the most important elements, yet often overlooked, is the ball position in relation to the golfers forward heel. Ben Hogan in his classic book "Five Lessons: The Modem Fundamentals of Golf" said in best. "The golfer uses the same fundamental swing for every shot he plays. On all standard shots the ball should be spotted in the same position relative to the left foot". Most professional golfers agree that this spot is about two inches inside the forward heel.

From the discussion of the prior art, it is apparent that there exists a need to contain in one simple device, the training tools necessary to aid the amateur golfer as well as the expert golfer with the ability to develop and maintain a good swing. This training aid should be able to align the golfers body correctly, it should be able to position the ball approximately two inches from the golfers forward heel, it should have the means to set the golfers feet at the correct distance from the golf ball, it should be applicable to right and left handed golfers, the golfer should be able to use a variety of woods and irons with the device, it should be applicable for male and female golfers of any size or shape, and it should be able to teach the golfer not only how to hit a straight golf shot, but also how to hit a controlled fade in varying degrees and a controlled draw in varying degrees without changing their swing or grip.

OBJECTS AND ADVANTAGES

Accordingly, the present invention provides a training system through which the golfer can develop a repeatable and consistent golf swing to enable him/her to hit a variety of different types of controlled golf shots without changing their swing or grip. The present invention accomplishes this goal through the following features.

The present invention provides an artificial turf with a foam rubber backing to produce a driving mat structure. A target arrow on the artificial turf is to be aimed at a specific target. The invention provides a means for securing the driving mat with spikes. The importance of these features is that the golfer will get instant feedback with every shot by observing the flight of the golf in relation to the balls path toward the intended target.

The present invention also provides a body alignment shaft and heel alignment block assembly. This assembly makes it easy for the golfer to quickly set up for the golf shot desired. With the golfers toes touching the body alignment shaft, their body is aligned correctly for the chosen shot. With the golfers forward heel touching the heel alignment block, the golf ball is always positioned approximately two inches from the golfers forward heel. The body alignment shaft and heel alignment block assembly can be moved up or down a shot selection indicator shaft to achieve the correct distance the golfers feet should be from the golf ball while using any wood or iron. These features take all the guesswork out of proper alignment, ball position and setting the distance from the golfers feet and the golf ball. These features also make it easy for the golfer to quickly set up to and hit many golf balls without the need to make any adjustments to the invention.

The present invention also provides a means for teaching the golfer to hit a variety of controlled fades and a variety of controlled draws as well as a straight shot. These controlled shots are accomplished by rotating a shot selection indicator shaft to a desired shot selection indicator hole.

The present invention also provides that right handed as well as left handed golfers can use the invention. This is accomplished by attaching the short end of the body alignment shaft on the left side of the heel alignment block for right handed golfers or attaching the short end of the body alignment shaft on the right side of the heel alignment block for left handed golfers.

The present invention also provides that golfers of various sizes and shapes using a variety of different clubs can use the invention.

These together with other objects, advantages and applications of the present invention will become apparent to those skilled in the art when the following description is read in conjunction with the accompanying drawings.

DRAWING FIGURES

REFERENCE NUBERALS IN DRAWING

| | | | |
|---|---|---|---|
| 10 | Artificial turf | 12 | Target arrow |
| 14 | Shot selection holes | 16 | Spike |
| 20 | Foam rubber | 24 | Rubber tee |
| 30 | Stabilizer bar | 32 | Center pivot hole |
| 34 | Center pivot cutout | 36 | Bolt |
| 38 | Wing nut | 40 | Shot selection indicator shaft |
| 42 | Cutout | 44 | Groove |
| 46 | Indication marks | 50 | Heel alignment block |
| 52 | Tongue | 60 | Body alignment shaft |
| 64 | Screw | | |

DESCRIPTION—FIGS. 1A, 1B

Figure 1A:
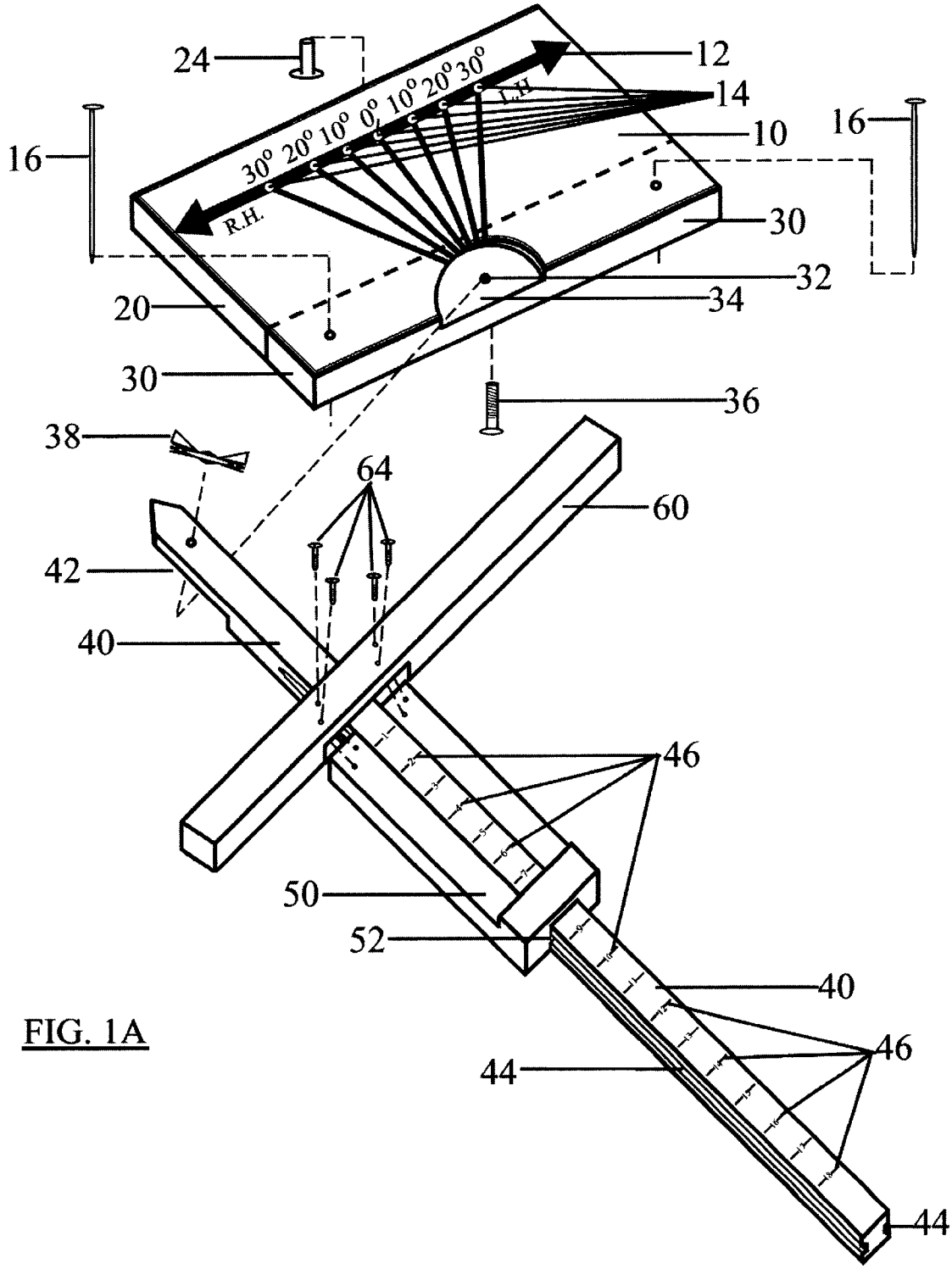
FIG. 1A is a perspective view that shows all the parts for the entire invention. It is shown being set up for a right-handed golfer.
Figure 1B:
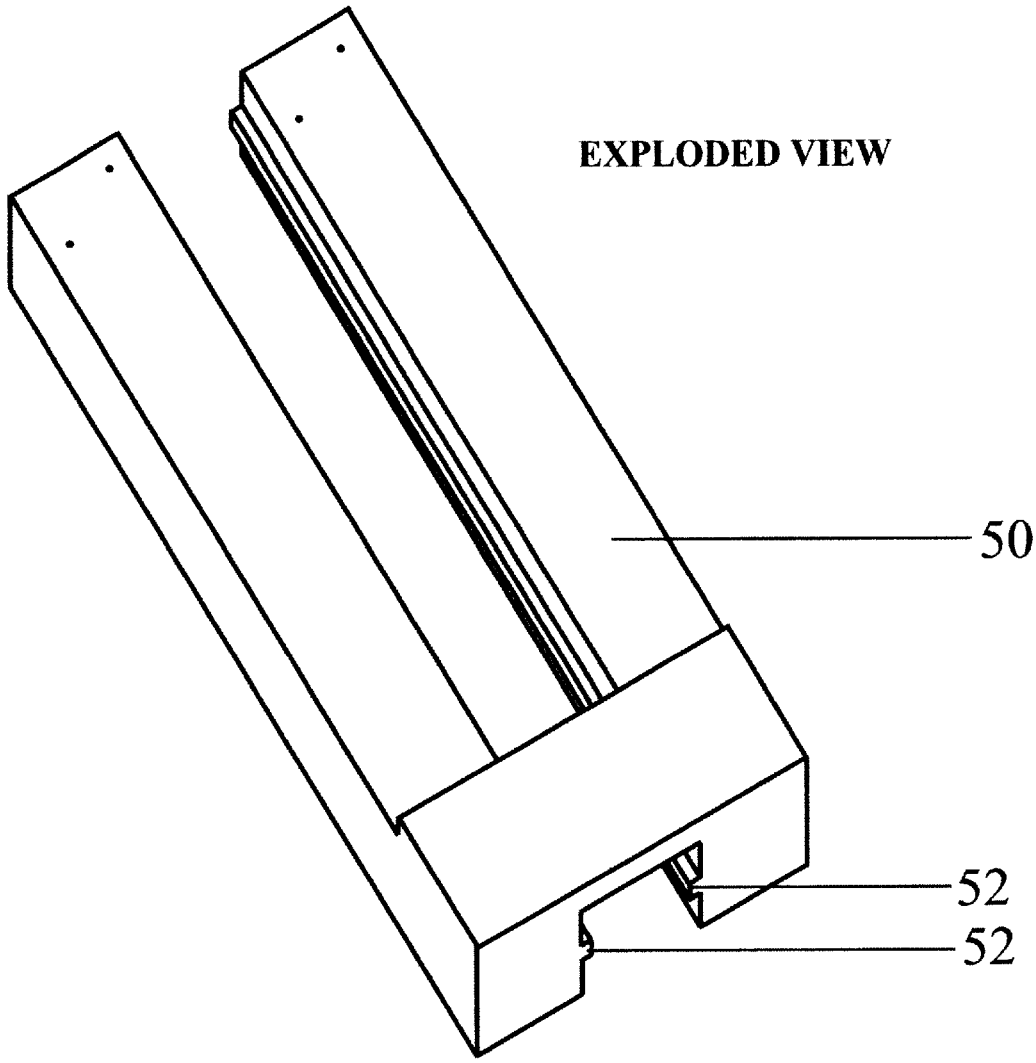
FIG. 1B is an exploded perspective view of the heel alignment block.

An embodiment of the invention is illustrated in FIG. 1A. An exploded view of the heel alignment block is illustrated in FIG. 1B. The artificial turf 10 is approximately ¼ by 12 by 18 inches. A sheet of foam rubber 20 is adhered to the under side of the top section of the artificial turf 10 to provide some bounce when hitting a golf shot. The foam rubber 20 sheet is approximately ¾ by 8½ by 18 inches. A stabilizer bar 30 is adhered to the under side of the bottom section of the artificial turf 10. Two holes are drilled through the right and left ends of the stabilizer bar 30 and artificial turf 10. These holes are used for inserting two spikes 16 through the holes and driving into the ground to hold the artificial turf 10 in place when using the invention on natural grass. The artificial turf 10 and the stabilizer bar 30 have a center pivot cutout 34 for the rotation of the shot selection indicator shaft 40. A center pivot hole 32 is drilled into the stabilizer bar 30 to attach the shot selection indicator shaft 40 to the stabilizer bar 30 with a bolt 36 and wing nut 38. The artificial turf 10 has a target arrow 12 painted on it that runs from end to end. The artificial turf 10 is also marked R.H. for right-handed golfers and L.H. for left-handed golfers. A shot selection hole 14 is drilled through the artificial turf 10 and foam rubber 20 in the middle of the target arrow 12. It is marked as 0-degrees. Six more shot selection holes 14 are drilled through the artificial turf 10 and the foam rubber 20 along the target arrow 12, three shot selection holes 14 to the right of the 0-degree shot selection hole 14 and three shot selection holes 14 to the left of the 0-degree shot selection hole 14. These shot selection holes 14 are incremented by ten degrees of a line that runs from the center of the 0-degree shot selection hole 14 and the center of the center pivot hole 32. The shot selection holes 14 are marked according to their degree reading. The shot selection holes 14 can receive a rubber tee 24 if desired.

The shot selection indicator shaft 40 is approximately ¾ by 1⅝ by 36 inches. It has a hole drilled through it near the top to receive the attaching bolt 36. The shot selection indicator shaft 40 has a cutout 42 at the top on the under side for ease of rotating in the center pivot cutout 34. A groove 44 is cut in each side of the shot selection indicator shaft 40. The shot selection indicator shaft 40 also has indication marks 46 printed on its topside.

The heel alignment block 50 is approximately 1 by 12 by 5½ inches. It has a dado cut in the bottom and runs the entire length of the heel alignment block 50. A tongue 52 is also in both sides of the dado. The dado and tongues 52 allow the shot selection indicator shaft 40 to be inserted onto the heel alignment block 50, which allows the heel alignment block 50 to slide up and down the shot selection shaft 40. Approximately 9 inches of the heel alignment block 50 is cut away on top to a depth of ¼ inch for aesthetic purposes.

The body alignment shaft 60 is approximately 1 by 1⅝ by 26½ inches. It has a cutout of approximately ¾ by 5½ inches. The cutout is approximately 5½ inches from the end of the body alignment shaft. The cutout is for fitting over the heel alignment block 50 and attaching it with four screws 64 to the heel alignment block. Attaching the body alignment shaft 60 to the heel alignment block 50 with the short end of the body alignment shaft 60 on the left, you are set up for use by a right-handed golfer. Attach the short end to the right side of the heel alignment block 50 for a left-handed golfer.

OPERATION—FIGS. 1A, 1B

The golf shot shaper training aid is intended for use on a golf driving range. While the invention can be used with any wood or iron, the operation described herein describes its use with a mid-range iron.

Since either right-handed or left-handed golfers can use this invention, the description for the operation will be described for each separately.

The right-handed golfer:

Attach the body alignment shaft 60 to the heel alignment block 50 with the four screws 64. The short end of the body alignment shaft 60 will be on the left side of the heel alignment block 50 as illustrated in FIG. 1A. Slide the heel alignment block 50 onto the shot selection indicator shaft 40 by means of the two tongues 52 and two grooves 44. Insert the rubber tee 24 up and through the shot selection hole 14 marked as 0-degrees. Insert the bolt 36 through the underside of the center pivot hole 32. Place the shot selection indicator shaft 40 onto the bolt 36. Aim the target arrow 12, which is labeled R. H., to a specific target on the driving range. Tamp the two spikes 16 through the two holes in the artificial turf 10 and the stabilizer bar 30 into the ground to secure into place. If the driving range in use only has driving mats to hit off of, the two spikes 16 obviously cannot be used. If this is the case, my invention should be placed directly on the driving mat. The target arrow 12 will have to be periodically checked for alignment with the target. Align the shot selection indicator shaft 40 with the 0-degree shot selection hole 14 and secure the shot selection indicator shaft 40 by threading the wing nut 38 to the bolt 36 and tightening. Place a golf ball on the rubber tee 24.

Set up to the golf ball with a mid-range iron. The golfers left toe should be just touching the short end of the body alignment shaft 60 and the golfers left heel should be just touching the left side of the heel alignment block 50. The golfers right toe should be just touching the long end of the body alignment shaft 60, with their feet at a comfortable distance apart. The heel alignment block 50 and body alignment shaft 60 assembly may need to be moved either up or back on the shot selection indicator shaft 40 in order to achieve a comfortable stance over the ball. The heel alignment block 50 and body alignment shaft 60 assembly's position as it relates to the indication marks 46 on the shot selection indicator shaft 40, should be noted. This will ensure that you are standing the same distance from the ball on repetitive shots. The club head should be square (perpendicular) to the target arrow 12 when addressing the ball. The golfer is now set up to hit a straight golf shot. Their feet, hips and shoulders are aligned with the target and the ball is positioned approximately 2 inches from their left heel. Note, that on a straight golf shot, the club head should travel in line with the target arrow 12 through the hitting zone.

Loosen the wing nut 38 and rotate the shot selection indicator shaft 40 counter clock wise until it is inline with the 10-degree shot selection hole 14 to the left of the 0-degree shot selection hole 14. Tighten the wing nut 38 to secure the shot selection indicator shaft 40. Remove the rubber tee 24 and insert it into this 10-degree shot selection hole 14. Set up to the golf ball in the same manner as described above. The golfers left toe should be just touching the short end of the body alignment shaft 60 and the golfers left heel should be just touching the left side of the heel alignment block 50. The golfers right toe should be just touching the long end of the body alignment shaft 60, with their feet at a comfortable distance apart. The heel alignment block 50 and body alignment shaft 60 assembly may need to be moved either up or back on the shot selection indicator shaft 40 in order to achieve a comfortable stance over the ball. The club head should be square (perpendicular) to the target arrow 12 when addressing the ball. The golfer is now set up to hit a slight fade (a ball that moves from left to right). Note that the golfers body is open in relation to the target and that their club head is open in relation to their stance. The golf ball is still positioned approximately 2 inches from the golfers left heel. Note further, that while using your same swing, the club head path will be slightly outside in in relation to the target arrow 12 through the hitting zone. From this position, the golf ball will start out on a path slightly left of the target and fade back to the target.

Loosen the wing nut 38 and rotate the shot selection indicator shaft 40 counter clock wise until it is inline with the 20-degree shot selection hole 14 to the left of the 0-degree shot selection hole 14. Tighten the wing nut 38 to secure the shot selection indicator shaft 40. Remove the rubber tee 24 and insert it into this 20-degree shot selection hole 14. Set up to the golf ball in the same manner as described above. The golfers left toe should be just touching the short end of the body alignment shaft 60 and the golfers left heel should be just touching the left side of the heel alignment block 50. The golfers right toe should be just touching the long end of the body alignment shaft 60, with their feet at a comfortable distance apart. The heel alignment block 50 and body alignment shaft 60 assembly may need to be moved either up or back on the shot selection indicator shaft 40 in order to achieve a comfortable stance over the ball. The club head should be square (perpendicular) to the target arrow 12 when addressing the ball. The golfer is now set up to hit a more severe fade (a ball that moves further from left to right). Note that the golfers body is open in relation to the target and that their club head is open in relation to their stance. The golf ball is still positioned approximately 2 inches from the golfers left heel. Note further, that while using your same swing, the club head path will be outside in in relation to the target arrow 12 through the hitting zone. From this position, the golf ball will start out on a path further left of the target then above but will still fade back to the target.

Loosen the wing nut 38 and rotate the shot selection indicator shaft 40 counter clock wise until it is inline with the 30-degree shot selection hole 14 to the left of the 0-degree shot selection hole 14. Tighten the wing nut 38 to secure the shot selection indicator shaft 40. Remove the rubber tee 24 and insert it into this 30-degree shot selection hole 14. Set up to the golf ball in the same manner as described above. The golfers left toe should be just touching the short end of the body alignment shaft 60 and the golfers left heel should be just touching the left side of the heel alignment block 50. The golfers right toe should be just touching the long end of the body alignment shaft 60, with their feet at a comfortable distance apart. The heel alignment block 50 and body alignment shaft 60 assembly may need to be moved either up or back on the shot selection indicator shaft 40 in order to achieve a comfortable stance over the ball. The club head should be square (perpendicular) to the target arrow 12 when addressing the ball. The golfer is now set up to hit a severe fade (a ball that moves severely from left to right). Note that the golfers body is open in relation to the target and that their club head is open in relation to their stance. The golf ball is still positioned approximately 2 inches from the golfers left heel. Note further, that while using your same swing, the club head path will be severely outside in in relation to the target arrow 12 through the hitting zone. From this position, the golf ball will start out on a path severely left of the target but will still fade back to the target.

Loosen the wing nut 38 and rotate the shot selection indicator shaft 40 clock wise until it is inline with the 10-degree shot selection hole 14 to the right of the 0-degree shot selection hole 14. Tighten the wing nut 38 to secure the shot selection indicator shaft 40. Remove the rubber tee 24 and insert it into this 10-degree shot selection hole 14. Set up to the golf ball in the same manner as described above. The golfers left toe should be just touching the short end of the body alignment shaft 60 and the golfers left heel should be just touching the left side of the heel alignment block 50. The golfers right toe should be just touching the long end of the body alignment shaft 60, with their feet at a comfortable distance apart. The heel alignment block 50 and body alignment shaft 60 assembly may need to be moved either up or back on the shot selection indicator shaft 40 in order to achieve a comfortable stance over the ball. The club head should be square (perpendicular) to the target arrow 12 when addressing the ball. The golfer is now set up to hit a slight draw (a ball that moves slightly from right to left). Note that the golfers body is slightly closed in relation to the target and that their club head is slightly closed in relation to their stance. The golf ball is still positioned approximately 2 inches from the golfers left heel. Note further, that while using your same swing, the club head path will be slightly inside out in relation to the target arrow 12 through the hitting zone. From this position, the golf ball will start out on a path slightly right of the target and will draw back to the target.

Loosen the wing nut 38 and rotate the shot selection indicator shaft 40 clock wise until it is inline with the 20-degree shot selection hole 14 to the right of the 0-degree shot selection hole 14. Tighten the wing nut 38 to secure the shot selection indicator shaft 40. Remove the rubber tee 24 and insert it into this 20-degree shot selection hole 14. Set up to the golf ball in the same manner as described above. The golfers left toe should be just touching the short end of the body alignment shaft 60 and the golfers left heel should be just touching the left side of the heel alignment block 50. The golfers right toe should be just touching the long end of the body alignment shaft 60, with their feet at a comfortable distance apart. The heel alignment block 50 and body alignment shaft 60 assembly may need to be moved either up or back on the shot selection indicator shaft 40 in order to achieve a comfortable stance over the ball. The club head should be square (perpendicular) to the target arrow 12 when addressing the ball. The golfer is now set up to hit a more severe draw (a ball that moves further from right to left). Note that the golfers body is closed in relation to the target and that their club head is closed in relation to their stance. The golf ball is still positioned approximately 2 inches from the golfers left heel. Note further, that while using your same swing, the club head path will be inside out in relation to the target arrow 12 through the hitting zone. From this position, the golf ball will start out on a path further right of the target then above but will still draw back to the target.

Loosen the wing nut 38 and rotate the shot selection indicator shaft 40 clock wise until it is inline with the 30-degree shot selection hole 14 to the right of the 0-degree shot selection hole 14. Tighten the wing nut 38 to secure the shot selection indicator shaft 40. Remove the rubber tee 24 and insert it into this 30-degree shot selection hole 14. Set up to the golf ball in the same manner as described above. The golfers left toe should be just touching the short end of the body alignment shaft 60 and the golfers left heel should be just touching the left side of the heel alignment block 50. The golfers right toe should be just touching the long end of the body alignment shaft 60, with their feet at a comfortable distance apart. The heel alignment block 50 and body alignment shaft 60 assembly may need to be moved either up or back on the shot selection indicator shaft 40 in order to achieve a comfortable stance over the ball. The club head should be square (perpendicular) to the target arrow 12 when addressing the ball. The golfer is now set up to hit a severe draw (a ball that moves severely from right to left). Note that the golfers body is severely closed in relation to the target and that their club head is severely closed in relation to their stance. The golf ball is still positioned approximately 2 inches from the golfers left heel. Note further, that while using your same swing, the club head path will be severely inside out in relation to the target arrow 12 through the hitting zone. From this position, the golf ball will start out on a path severely right of the target but will still draw back to the target.

The left-handed golfer:

Attach the body alignment shaft 60 to the heel alignment block 50 with the four screws 64. The short end of the body alignment shaft 60 will be on the right side of the heel alignment block 50. Slide the heel alignment block 50 onto the shot selection indicator shaft 40 by means of the two tongues 52 and two grooves 44. Insert the rubber tee 24 up and through the shot selection hole 14 marked as 0-degrees. Insert the bolt 36 through the underside of the center pivot hole 32. Place the shot selection indicator shaft 40 onto the bolt 36. Aim the target arrow 12, which is labeled L.H., to a specific target on the driving range. Tamp the two spikes 16 through the two holes in the artificial turf 10 and the stabilizer bar 30 into the ground to secure into place. If the driving range in use only has driving mats to hit off of, the two spikes 16 obviously cannot be used. If this is the case, my invention should be placed directly on the driving mat. The target arrow 12 will have to be periodically checked for alignment with the target. Align the shot selection indicator shaft 40 with the 0-degree shot selection hole 14 and secure the shot selection indicator shaft 40 by threading the wing nut 38 to the bolt 36 and tightening. Place a golf ball on the rubber tee 24.

Set up to the golf ball with a mid-range iron. The golfers right toe should be just touching the short end of the body alignment shaft 60 and the golfers right heel should be just touching the right side of the heel alignment block 50. The golfers left toe should be just touching the long end of the body alignment shaft 60, with their feet at a comfortable distance apart. The heel alignment block 50 and body alignment shaft 60 assembly may need to be moved either up or back on the shot selection indicator shaft 40 in order to achieve a comfortable stance over the ball. The club head should be square (perpendicular) to the target arrow 12 when addressing the ball. The golfer is now set up to hit a straight golf shot. Their feet, hips and shoulders are aligned with the target and the ball is positioned approximately 2 inches from their right heel. Note, that on a straight golf shot, the club head path should travel in line with the target arrow 12 through the hitting zone.

Loosen the wing nut 38 and rotate the shot selection indicator shaft 40 clock wise until it is inline with the 10-degree shot selection hole 14 to the right of the 0-degree shot selection hole 14. Tighten the wing nut 38 to secure the shot selection indicator shaft 40. Remove the rubber tee 24 and insert it into this 10-degree shot selection hole 14. Set up to the golf ball in the same manner as described above. The golfers right toe should be just touching the short end of the body alignment shaft 60 and the golfers right heel should be just touching the right side of the heel alignment block 50. The golfers left toe should be just touching the long end of the body alignment shaft 60, with their feet at a comfortable distance apart. The heel alignment block 50 and body alignment shaft 60 assembly may need to be moved either up or back on the shot selection indicator shaft 40 in order to achieve a comfortable stance over the ball. The heel alignment block 50 and body alignment shaft 60 assembly's position as it relates to the indication marks 46 on the shot selection indicator shaft 40, should be noted. This will ensure that you are standing the same distance from the ball on repetitive shots. The club head should be square (perpendicular) to the target arrow 12 when addressing the ball. The golfer is now set up to hit a slight fade (a ball that moves slightly from right to left). Note that the golfers body is open in relation to the target and that their club head is open in relation to their stance. The golf ball is still positioned approximately 2 inches from the golfers right heel. Note further, that while using your same swing, the club head path will be slightly outside in in relation to the target arrow 12 through the hitting zone. From this position, the golf ball will start out on a path slightly right of the target and fade back to the target.

Loosen the wing nut 38 and rotate the shot selection indicator shaft 40 clock wise until it is inline with the 20-degree shot selection hole 14 to the right of the 0-degree shot selection hole 14. Tighten the wing nut 38 to secure the shot selection indicator shaft 40. Remove the rubber tee 24 and insert it into this 20-degree shot selection hole 14. Set up to the golf ball in the same manner as described above. The golfers right toe should be just touching the short end of the body alignment shaft 60 and the golfers right heel should be just touching the right side of the heel alignment block 50. The golfers left toe should be just touching the long end of the body alignment shaft 60, with their feet at a comfortable distance apart. The heel alignment block 50 and body alignment shaft 60 assembly may need to be moved either up or back on the shot selection indicator shaft 40 in order to achieve a comfortable stance over the ball. The club head should be square (perpendicular) to the target arrow 12 when addressing the ball. The golfer is now set up to hit a more severe fade (a ball that moves further from right to left). Note that the golfers body is open in relation to the target and that their club head is open in relation to their stance. The golf ball is still positioned approximately 2 inches from the golfers right heel. Note further, that while using your same swing, the club head path will be more severely outside in in relation to the target arrow 12 through the hitting zone. From this position, the golf ball will start out on a path further right of the target then above but will still fade back to the target.

Loosen the wing nut 38 and rotate the shot selection indicator shaft 40 clock wise until it is inline with the 30-degree shot selection hole 14 to the right of the 0-degree shot selection hole 14. Tighten the wing nut 38 to secure the shot selection indicator shaft 40. Remove the rubber tee 24 and insert it into this 30-degree shot selection hole 14. Set up to the golf ball in the same manner as described above. The golfers right toe should be just touching the short end of the body alignment shaft 60 and the golfers right heel should be just touching the right side of the heel alignment block 50. The golfers left toe should be just touching the long end of the body alignment shaft 60, with their feet at a comfortable distance apart. The heel alignment block 50 and body alignment shaft 60 assembly may need to be moved either up or back on the shot selection indicator shaft 40 in order to achieve a comfortable stance over the ball. The club head should be square (perpendicular) to the target arrow 12 when addressing the ball. The golfer is now set up to hit a severe fade (a ball that moves severely from right to left). Note that the golfers body is open in relation to the target and that their club head is open in relation to their stance. The golf ball is still positioned approximately 2 inches from the golfers right heel. Note further, that while using your same swing, the club head path will be severely outside in in relation to the target arrow 12 through the hitting zone. From this position, the golf ball will start out on a path severely right of the target but will still fade back to the target.

Loosen the wing nut 38 and rotate the shot selection indicator shaft 40 counter clock wise until it is inline with the 10-degree shot selection hole 14 to the left of the 0-degree shot selection hole 14. Tighten the wing nut 38 to secure the shot selection indicator shaft 40. Remove the rubber tee 24 and insert it into this 10-degree shot selection hole 14. Set up to the golf ball in the same manner as described above. The golfers right toe should be just touching the short end of the body alignment shaft 60 and the golfers right heel should be just touching the right side of the heel alignment block 50. The golfers left toe should be just touching the long end of the body alignment shaft 60, with their feet at a comfortable distance apart. The heel alignment block 50 and body alignment shaft 60 assembly may need to be moved either up or back on the shot selection indicator shaft 40 in order to achieve a comfortable stance over the ball. The club head should be square (perpendicular) to the target arrow 12 when addressing the ball. The golfer is now set up to hit a slight draw (a ball that moves slightly from left to right). Note that the golfers body is slightly closed in relation to the target and that their club head is slightly closed in relation to their stance. The golf ball is still positioned approximately 2 inches from the golfers right heel. Note further, that while using your same swing, the club head path will be slightly inside out in relation to the target arrow 12 through the hitting zone. From this position, the golf ball will start out on a path slightly left of the target and draw back to the target.

Loosen the wing nut 38 and rotate the shot selection indicator shaft 40 counter clock wise until it is inline with the 20-degree shot selection hole 14 to the left of the 0-degree shot selection hole 14. Tighten the wing nut 38 to secure the shot selection indicator shaft 40. Remove the rubber tee 24 and insert it into this 20-degree shot selection hole 14. Set up to the golf ball in the same manner as described above. The golfers right toe should be just touching the short end of the body alignment shaft 60 and the golfers right heel should be just touching the right side of the heel alignment block 50. The golfers left toe should be just touching the long end of the body alignment shaft 60, with their feet at a comfortable distance apart. The heel alignment block 50 and body alignment shaft 60 assembly may need to be moved either up or back on the shot selection indicator shaft 40 in order to achieve a comfortable stance over the ball. The club head should be square (perpendicular) to the target arrow 12 when addressing the ball. The golfer is now set up to hit a more severe draw (a ball that moves further from left to right). Note that the golfers body is closed in relation to the target and that their club head is closed in relation to their stance. The golf ball is still positioned approximately 2 inches from the golfers right heel. Note further, that while using your same swing, the club head path will be further inside out in relation to the target arrow 12 through the hitting zone. From this position, the golf ball will start out on a path further left of the target then above and will draw back to the target.

Loosen the wing nut 38 and rotate the shot selection indicator shaft 40 counter clock wise until it is inline with the 30-degree shot selection hole 14 to the left of the 0-degree shot selection hole 14. Tighten the wing nut 38 to secure the shot selection indicator shaft 40. Remove the rubber tee 24 and insert it into this 30-degree shot selection hole 14. Set up to the golf ball in the same manner as described above. The golfers right toe should be just touching the short end of the body alignment shaft 60 and the golfers right heel should be just touching the right side of the heel alignment block 50. The golfers left toe should be just touching the long end of the body alignment shaft 60, with their feet at a comfortable distance apart. The heel alignment block 50 and body alignment shaft 60 assembly may need to be moved either up or back on the shot selection indicator shaft 40 in order to achieve a comfortable stance over the ball. The club head should be square (perpendicular) to the target arrow 12 when addressing the ball. The golfer is now set up to hit a severe draw (a ball that moves severely from left to right). Note that the golfers body is severely closed in relation to the target and that their club head is severely closed in relation to their stance. The golf ball is still positioned approximately 2 inches from the golfers right heel. Note further, that while using your same swing, the club head path will be severely inside out in relation to the target arrow 12 through the hitting zone. From this position, the golf ball will start out on a path severely left of the target but will still draw back to the target.

SUMMARY, RAMIFICATION, AND SCOPE

Although the description above contains many specificities, these should not be construed as limiting the scope of the invention but as merely providing illustrations of some of the presently preferred embodiments of this invention.

Thus the scope of the invention should be determined by the appended claims and their legal equivalents, rather than by the example given.

I claim:

1. A golf training aid, usable for right handed or left handed golfers, for teaching the golfer how to hit a golf ball straight, how to hit a golf ball that moves from left to right in varying degrees, how to hit a golf ball that moves from right to left in varying degrees, and how to position the golf ball in relation to your forward heel, while using the same golf swing, comprising:

a) an artificial turf, b) foam rubber attached to the underside of said artificial turf, c) a target arrow painted or drawn on said artificial turf, d) a stabilizer bar attached to the underside of said artificial turf by means of glue or other suitable means, e) a center pivot cutout in a semicircle shape in said artificial turf and said stabilizer bar, f) a center pivot hole drilled or pressed in the middle of said center pivot cutout, g) shot selection holes drilled or pressed through said artificial turf and said foam rubber along the said target arrow, with the zero degree hole being in the center of said target arrow and continuing to the right and left of the zero degree hole on said target arrow at ten degree intervals of a line from the center of the said center pivot hole and the center of the zero degree hole to thirty degrees, h) a rubber tee for inserting through one of the said shot selection holes, i) two spikes to be inserted through two drilled or pressed holes in said stabilizer bar and said artificial turf for attaching and securing said stabilizer bar to natural turf.

2. The golf training aid of claim 1, further comprising:

a) a bolt, b) a wing nut, c) a cutout, d) a shot selection indicator shaft with said cutout, attached to said stabilizer bar with said bolt, extending up and through said center pivot hole and said shot selection indicator shaft, and said wing nut to allow said shot selection indicator shaft to rotate left and right on said stabilizer bar.

3. The golf training aid of claim 2, further comprising:

a) two grooves, b) two tongues, c) a heel alignment block, for positioning the golf ball approximately 2 inches from the golfers forward heel, which will slide forward and backwards on said shot selection indicator shaft by means of two said grooves in said shot selection indicator shaft and two said tongues in said heel alignment block.

4. The golf training aid of claim 3, further comprising:

a) screws, b) a body alignment shaft for positioning the golfers body in the correct alignment for a particular shot, attached to said forward heel alignment block by said screws, noting attachment can be made for either a right handed golfer or a left handed golfer.

5. The golf training aid of claim 2, further comprising indicator marks placed on said shot selection indicator shaft.

* * * * *